US008181639B2

(12) United States Patent
Scott et al.

(10) Patent No.: US 8,181,639 B2
(45) Date of Patent: May 22, 2012

(54) GRATES WITH HEAT SHIELD

(75) Inventors: Timothy D. Scott, Greenbrier, TN (US); Adam Clark, Erin, TN (US); Ronald G. Brant, Greenbrier, TN (US); David Joseph Haupt, Gallatin, TN (US); Bruce Gerald Sheaves, Adams, TN (US)

(73) Assignee: Electrolux Home Products, Inc., Charlotte, NC (US)

( * ) Notice: Subject to any disclaimer, the term of this patent is extended or adjusted under 35 U.S.C. 154(b) by 257 days.

(21) Appl. No.: 12/104,026

(22) Filed: Apr. 16, 2008

(65) Prior Publication Data

US 2009/0260614 A1 Oct. 22, 2009

(51) Int. Cl.
*F23H 1/00* (2006.01)

(52) U.S. Cl. ..... 126/152 R; 126/152 B; 126/163 R; 126/201; 126/214 D; 126/299 C; 126/39 K; 126/400; 126/540

(58) Field of Classification Search ..... 126/152 B, 126/152 R, 163 R, 201, 214 D, 299 C, 39 K, 126/400, 540
See application file for complete search history.

(56) References Cited

U.S. PATENT DOCUMENTS

| | | | | | |
|---|---|---|---|---|---|
| 1,532,839 | A | * | 4/1925 | Sherman | 126/39 B |
| 1,546,650 | A | * | 7/1925 | Graham | 126/39 K |
| 1,649,006 | A | | 2/1927 | Wilcox | |
| 1,726,687 | A | * | 9/1929 | Wilcox | 126/45 |
| 2,187,169 | A | * | 1/1940 | Mills | 126/39 H |
| 2,223,961 | A | * | 12/1940 | Mills | 126/39 H |
| 2,257,398 | A | * | 9/1941 | Parker | 126/214 C |
| 2,430,079 | A | * | 11/1947 | Reeves | 126/214 C |
| 2,440,035 | A | * | 4/1948 | Williams et al. | 126/214 C |
| 2,473,478 | A | * | 6/1949 | Stevens | 126/214 C |
| 2,614,620 | A | * | 10/1952 | Chambers | 431/194 |
| 2,632,436 | A | * | 3/1953 | Williams | 126/214 C |
| 2,678,643 | A | * | 5/1954 | Williams | 126/214 C |
| 2,861,563 | A | * | 11/1958 | Jensen | 126/214 C |
| 3,078,836 | A | * | 2/1963 | Clark | 126/39 H |
| 3,187,742 | A | | 6/1965 | Powers | |

(Continued)

FOREIGN PATENT DOCUMENTS

JP 20000121073 4/2000

(Continued)

OTHER PUBLICATIONS

International Search Report for PCT/US2009/040445, dated Jan. 8, 2010, 2 pages.

*Primary Examiner* — Kenneth Rinehart
*Assistant Examiner* — Jorge Pereiro
(74) *Attorney, Agent, or Firm* — Pearne & Gordon LLP

(57) ABSTRACT

In accordance with one aspect of the present invention, a cooking apparatus is provided. The cooking apparatus comprises a cooking surface, at least one grate, and a guard. The cooking surface includes at least one heat source and a control panel. The at least one grate is provided over a portion of the cooking surface. The guard is coupled to the at least one grate. The guard includes a first side and a second side. The first side of the guard is configured to deflect heat radiating from the at least one heat source. The second side of the guard corresponds with a sidewall of the cooking surface to form a channel between the guard and the sidewall. The channel is configured to create a thermal barrier between the at least one heat source and the control panel.

20 Claims, 4 Drawing Sheets

U.S. PATENT DOCUMENTS

| | | | | | |
|---|---|---|---|---|---|
| 3,299,941 | A | * | 1/1967 | Frick | 431/192 |
| 3,375,819 | A | * | 4/1968 | Davis | 126/211 |
| 3,450,429 | A | * | 6/1969 | Stata | 296/97.23 |
| 3,658,049 | A | * | 4/1972 | Gerber | 126/215 |
| 3,871,356 | A | | 3/1975 | Saponara | |
| 4,620,526 | A | | 11/1986 | Tetschner | |
| 4,905,660 | A | * | 3/1990 | Leduc | 126/41 R |
| 4,942,864 | A | | 7/1990 | Esposito | |
| 5,002,039 | A | | 3/1991 | Esposito | |
| 5,041,720 | A | | 8/1991 | Esposito | |
| 5,119,802 | A | * | 6/1992 | Cherry et al. | 126/39 E |
| 5,372,121 | A | * | 12/1994 | Castillo et al. | 126/214 R |
| 5,850,779 | A | | 12/1998 | Zimmerman | |
| 6,196,143 | B1 | * | 3/2001 | Post | 110/268 |
| 6,588,417 | B2 | * | 7/2003 | Jones et al. | 126/215 |

FOREIGN PATENT DOCUMENTS

| | | | | |
|---|---|---|---|---|
| JP | 2004028575 | A | * | 1/2004 |
| JP | 2004144368 | A | * | 5/2004 |
| KR | 200402514 | | | 12/2005 |
| KR | 200428072 | | | 10/2006 |

* cited by examiner

GRATES WITH HEAT SHIELD

FIELD OF THE INVENTION

The present invention relates generally to grates for use with cooking apparatuses, and more particularly, to grates that support cooking implements or containers where the grates include at least one guard to prevent radiant heat from reaching a control panel.

BACKGROUND OF THE INVENTION

Typically, a cooking apparatus such as a range includes grates that are used to support a pot or pan, over the heat provided from a heating source, such as a gas burner. Conventionally, the grates are located directly over the gas burners and have a generally open geometry featuring a cooking support surface formed of a plurality of support members for supporting the cooking implement. However, because of the open geometry, a great deal of excess radiant heat from the burners leaks out around each of the sides of the grates. The radiant heat can cause excessive heat issues such as around a control panel that includes control knobs. The radiant heat can also cause excessive heat issues at other areas surrounding the heating elements.

BRIEF SUMMARY OF THE INVENTION

The following presents a simplified summary of the invention in order to provide a basic understanding of some example aspects of the invention. This summary is not an extensive overview of the invention. Moreover, this summary is not intended to identify critical elements of the invention nor delineate the scope of the invention. The sole purpose of the summary is to present some concepts of the invention in simplified form as a prelude to the more detailed description that is presented later.

In accordance with one aspect of the present invention, a cooking apparatus is provided. The cooking apparatus comprises a cooking surface, at least one grate, and a guard. The cooking surface includes at least one heat source and a control panel. The at least one grate is provided over a portion of the cooking surface. The guard is coupled to the at least one grate. The guard includes a first side and a second side. The first side of the guard is configured to deflect heat radiating from the at least one heat source. The second side of the guard corresponds with a sidewall of the cooking surface to form a channel between the guard and the sidewall. The channel is configured to create a thermal barrier between the at least one heat source and the control panel.

In accordance with another aspect of the present invention, a cooking apparatus is provided. The cooking apparatus comprises a cooking surface, at least one grate, and a guard. The cooking surface includes at least one heat source and a control panel. The at least one grate is provided over a portion of the cooking surface. The guard is coupled to the at least one grate. The guard includes a first side and a second side. The first side of the guard is configured to deflect heat radiating from the at least one heat source. The second side of the guard corresponds with a sidewall of the cooking surface to form a channel between the guard and the sidewall. The channel is configured to create a thermal barrier between the at least one heat source and the control panel. The guard is spaced a distance from the sidewall of the cooking surface so as to allow a flow of air through the channel. The first side of the guard is sloped from a bottom portion in an upwards direction towards the at least one heat source

BRIEF DESCRIPTION OF THE SEVERAL VIEWS OF THE DRAWINGS

The foregoing and other aspects of the present invention will become apparent to those skilled in the art to which the present invention relates upon reading the following description with reference to the accompanying drawings, in which.

DETAILED DESCRIPTION OF THE INVENTION

Figure 1A:
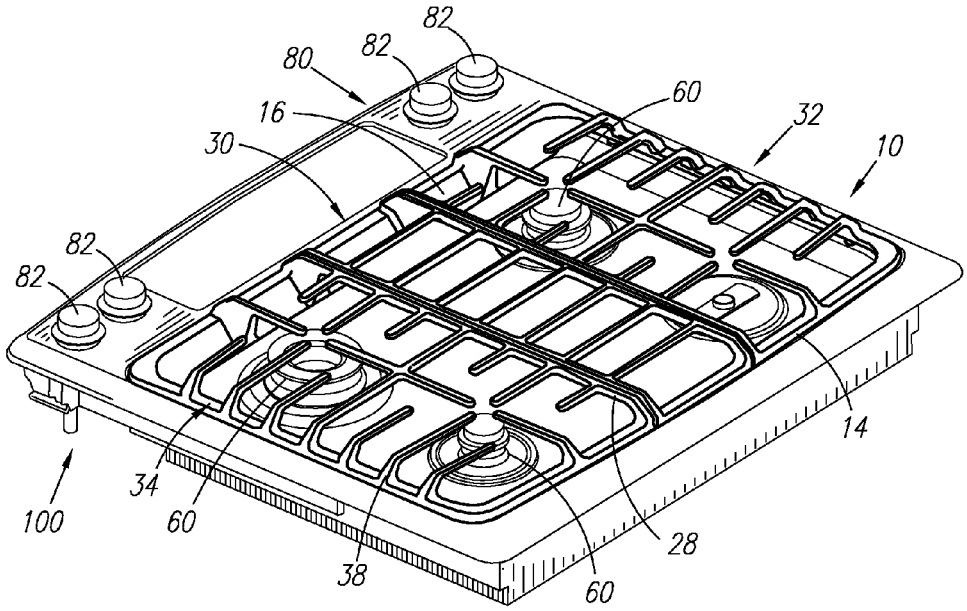
FIG. 1*a* is a perspective view of an example cooking apparatus with a first example grate that includes a guard.
Figure 1B:
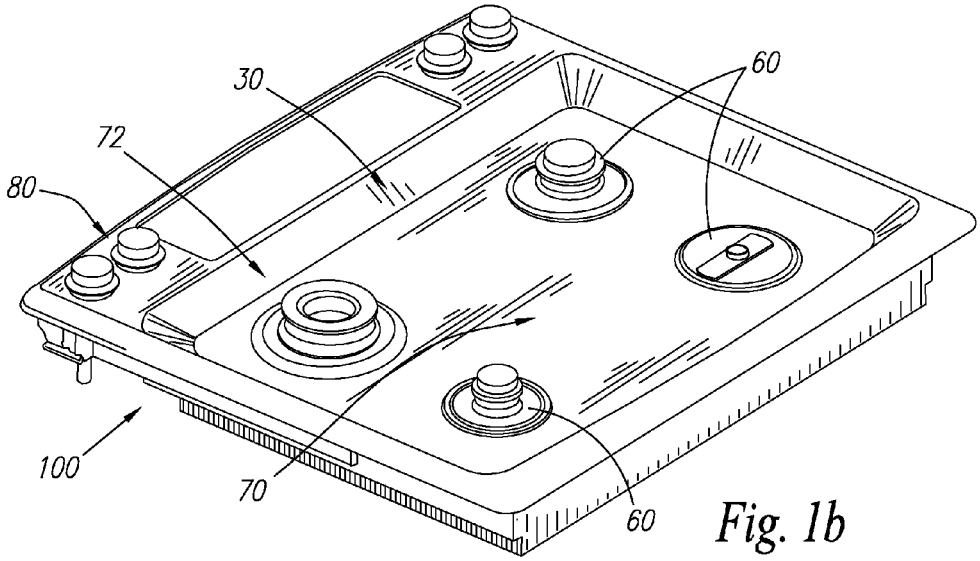
FIG. 1*b* is a perspective view of the example cooking apparatus of FIG. 1*a* before the grate is placed onto a cooking surface of the cooking apparatus.

Example embodiments that incorporate one or more aspects of the present invention are described and illustrated in the drawings. These illustrated examples are not intended to be a limitation on the present invention. For example, one or more aspects of the present invention can be utilized in other embodiments and even other types of devices. Moreover, certain terminology is used herein for convenience only and is not to be taken as a limitation on the present invention. Still further, in the drawings, the same reference numerals are employed for designating the same elements.

Turning to the shown example of FIGS. 1-5, the subject invention relates to a grate 10 for use with a cooking apparatus 100, such as a range. As seen in FIG. 1A, the cooking apparatus 100 includes at least one heat source 60. The heat source 60 can be a burner, such as a gas burner, or any other suitable heating apparatus. The at least one heat source 60 can be located at various locations throughout the top surface of the cooking apparatus 100 and in various arrangements. The grate 10 is configured for supporting cooking implements over the at least one heat source 60. A cooking implement can be a pot, a pan, a container, or other structure that is configured to be heated by the cooking apparatus. As seen in FIG. 1B, the cooking apparatus 100 can include a cooking surface 70 located on the top surface of the cooking apparatus 100. In the example shown, the cooking surface 70 is integral with the top portion of the cooking apparatus 100. In this example, the cooking surface 70 can be comprised of sheet metal that forms a portion of the top surface of the cooking apparatus 100. The cooking surface 70 can include a portion of the top surface of the cooking apparatus 100 that includes at least one heat source 60. The cooking surface 70 can also include a sidewall 72 that is placed along a front side 30 of the grate 10. It is appreciated that the cooking surface 70 can also include additional sidewalls relative to other sides of the grate 10. The cooking surface 70 can be located at a vertical position below the outer portions of the top surface of the cooking apparatus 100, such that the cooking surface 70 can be a cavity. In other examples, the cooking surface 70 can include a plurality of cavities where each portion includes at least one heat source 60. In other examples, the cooking surface 70 can be planar with the top surface of the cooking apparatus 100. In further examples, the cooking surface 70 can be vertically raised above the top surface of the cooking apparatus 100. The grate 10 can be configured to cover a portion of the cooking surface 70 or alternatively, the grate 10 can be configured to substantially cover the entire cooking surface 70. It is appreciated that the cooking surface 70 can have many types of configurations, shapes, and dimensions. As seen in FIG. 1A, the cooking apparatus 100 can also include a control panel 80. The control panel can include a plurality of controls 82, such as control knobs or touchpad elements as shown in the example of FIG. 1A and FIG. 1B.

Figure 2:
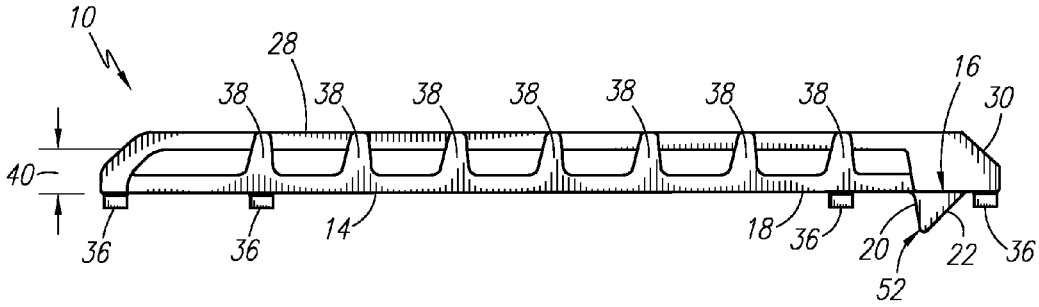
FIG. 2 is a side view of the grate of FIG. 1*a;*

As shown in FIG. 1A, the grate 10 includes a guard 16 that can be located on the top surface of the cooking apparatus 100. The guard 16 can be coupled to the at least one grate 10. The grate 10 can include a front side 30, a left side 32, and a right side 34. In FIG. 2, a side view of the grate 10 of FIG. 1A is shown. A single guard 16 in this example is located on a front side 30 of the grate 10, though in other examples, the guard 16 can be positioned in one or more other locations. The front side 30 of the grate 10 corresponds to the portion of the grate 10 that is closest to the control panel 80, as seen in FIG. 1A. The guard 16 can be located on a portion of the at least one grate 10 between the control panel 80 and the at least one heat source 60. In other examples, the guard 16 can be coupled to other locations, such as along a portion of the perimeter of the grate 10, along the entire perimeter of the grate 10, or across interior portions of the grate 10. Thus, the guard 16 can be located at various locations relative to the perimeter of the grate 10 and the heat source 60. The guard 16 is configured to deflect, shield, and inhibit the radiant heat emitted from the heat source 60 from extending beyond the grate 10. Moreover, the guard 16 is generally configured to deflect, shield, and inhibit radiant heat away from the control panel 80. For instance, the guard feature can be angled so that the heat can be directed upwards and towards the heating element and away from the control panel 80. Other directions can also be used, such as a generally upwards direction, to deflect the radiant heat away from the control panel 80. Thus, the guard 16 can provide additional protection for the control panel 80 and other structures located beyond the perimeter of the grate 10.

As shown in FIG. 2, the guard 16 can include a first side 20 and a second side 22. In the example shown, the first side 20 of the guard 16 can be an inner side and the second side 22 of the guard 16 can be an outer side. The first side 20 of the guard 16 is configured to deflect heat radiating from the at least one heat source 60. The guard 16 can have any suitable shape or geometry such as a curved geometry, a triangular geometry, a parallelogram geometry, a quadrilateral geometry, etc. As one further example, the first side 20 and the second side 22 can form a quadrilateral with a bottom side (not shown), where both the first side 20 and the second side 22 have substantially vertical orientations. In the example shown, the guard 16 has a triangular-shaped cross-section. The first side 20 of the guard 16 in this example can be sloped from a bottom portion in an upwards direction towards the source of the heat from the heat source 60. The second side 22 of the guard 16 in this example can be sloped from a bottom portion upwards in a direction towards the front side 30 of the grate 10. In other examples, the first side 20 and the second side 22 can have other orientations including a substantially vertical orientation or the first side 20 and the second side 22 can have a slope in other directions, such as the first side 20 is sloped from a bottom portion upwards and away from the heat source 60. The guard 16 in this example can have varying thicknesses corresponding to varying lengths for the bottom side.

As further shown in FIG. 2, the grate 10 can include a plurality of feet 36 that can be located on the underside of the grate 10. The plurality of feet 36 can be configured to rest upon the top surface of the cooking apparatus 100. The plurality of feet 36 can extend below a bottom surface 18 of the grate 10. As shown in FIG. 2, the guard 16 can extend downwardly a distance beyond the bottom surface 18 of the grate 10 to minimize radiant heat being transferred beyond the grate 10, such as to a control panel 80. Additionally or alternatively, the guard 16 can extend in an upwards direction relative to the bottom surface 18 of the grate 10.

FIG. 2 also shows a thermal barrier 52 provided by the guard 16. The guard 16 is configured to function as a thermal barrier for the heat radiating from the at least one heat source. In this example, the thermal barrier 52 is the amount of material in the guard 16. The guard 16 can act as a heat sink to dissipate the heat emitted from the heat source 60. Furthermore, the first side 20 of the guard 16 can be placed in an orientation to deflect the radiant heat. The thermal barrier 52 helps prevent the sidewall 72 of the cooking surface 70 from experiencing higher temperatures. The control panel 80 can be located on top of the same piece of material as the sidewall 72. Thus, the guard 16 reduces the temperatures that the control panel 80 will experience as the guard 16 reduces the temperature of the sidewall 72.

Figure 3:
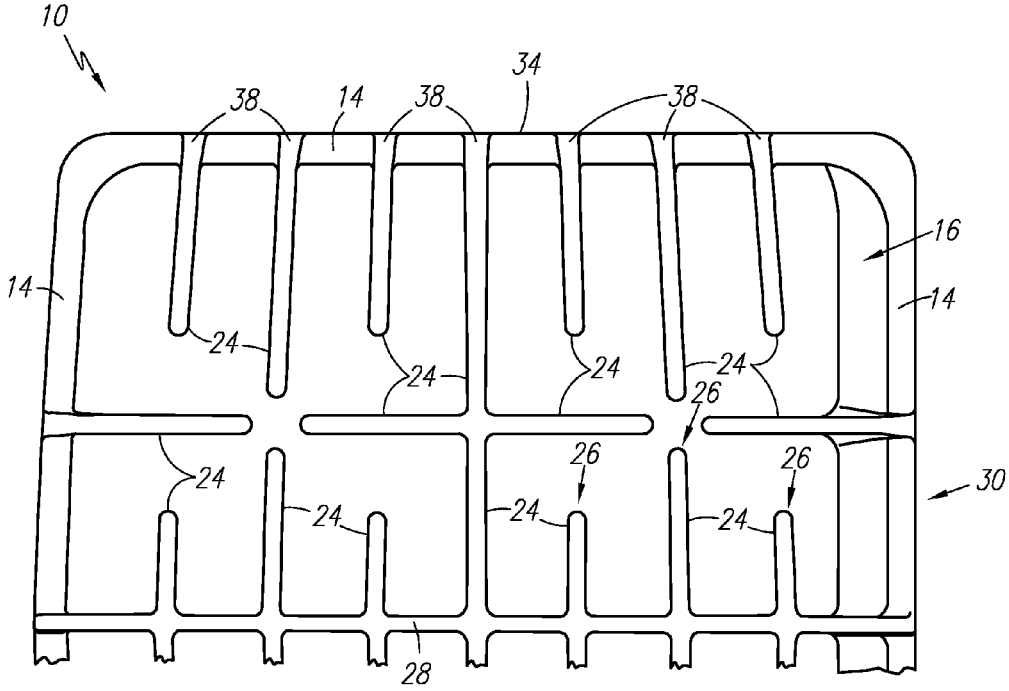
FIG. 3 is a top view of the grate of FIG. 2.
Figure 4:
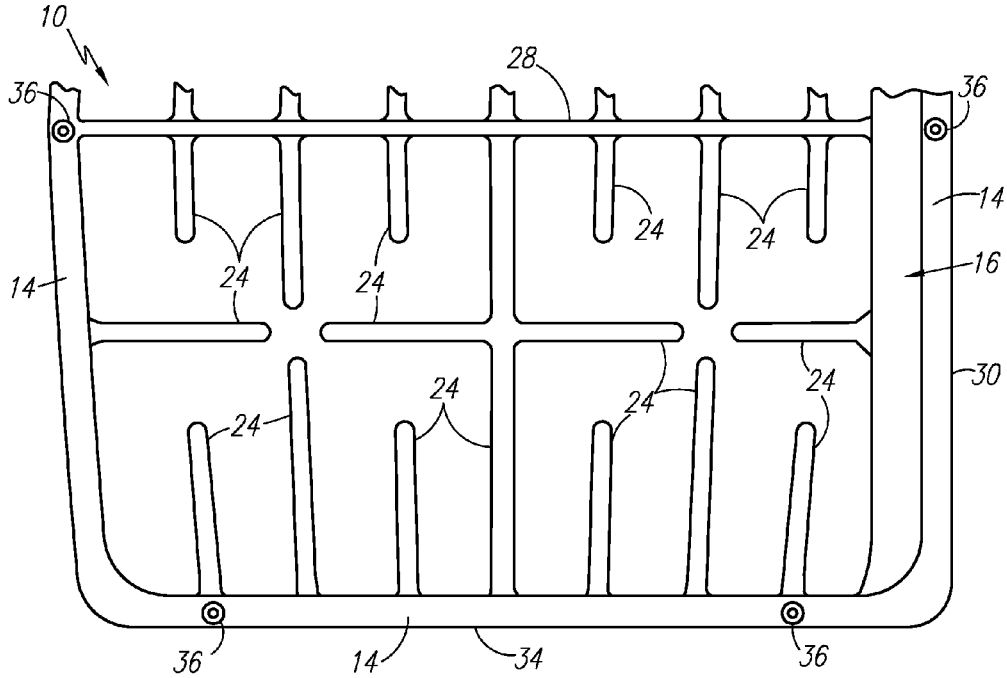
FIG. 4 is a bottom view of the grate of FIG. 1*a;*

FIGS. 3 & 4 show a top and bottom sectional view of FIG. 2 of one section of the grate 10. A first member 14 of the grate can extend along the perimeter of the grate 10 and can have varying thicknesses other than the thickness shown. The grate 10 can also include a plurality of support members 24. The plurality of support members 24 are configured to support one or more cooking implements, such as a pot, a pan, a container, or any other suitable structure. The plurality of support members 24 can extend from the first member 14 towards the interior of the grate 10, such as towards the center of the grate 10 and/or towards heat source 60 locations. The support members 24 can extend from the perimeter of the grate and have an end portion 26. The end portions 26 of the support members can be positioned near a heat source 60 or can be in other desired locations. The plurality of support members 24 can also include a continuous support member 28 that extends from one part of the perimeter of the grate 10 to another part of the perimeter of the grate 10, as also seen in FIGS. 1A, 2, 4, 5, 6, and 7. In other examples, the support members 24 can be oriented in directions other than vertical and horizontal. Moreover, the grate 10 or the first member 14 can also have shapes other than the quadrilateral shown, such as circular. FIG. 4 shows a bottom sectional view of the grate 10. In this view, the plurality of feet 36 can be seen that are configured to support the grate 10 in or on the cooking surface 70 of the cooking apparatus 100.

As seen in FIGS. 1A, 2, 3, and 5 the support members 24 can include an engagement portion 38. The engagement portion 38 of the support members 24 is configured to place each support member 24 at a desired vertical distance or height 40 from a bottom surface 18 of the grate 10, as seen in FIG. 2. The engagement portion 38 of the support members 24 can also be unitary with the plurality of support members 24. In the example shown, the support members 24 each extend upwardly from the first member 14, as shown by the height 40 of the engagement portion 38 in FIG. 2. The height 40 of the engagement portion 38 and the height of the guard 16 can both be altered in other examples which can change the amount of heat deflection.

Figure 5:
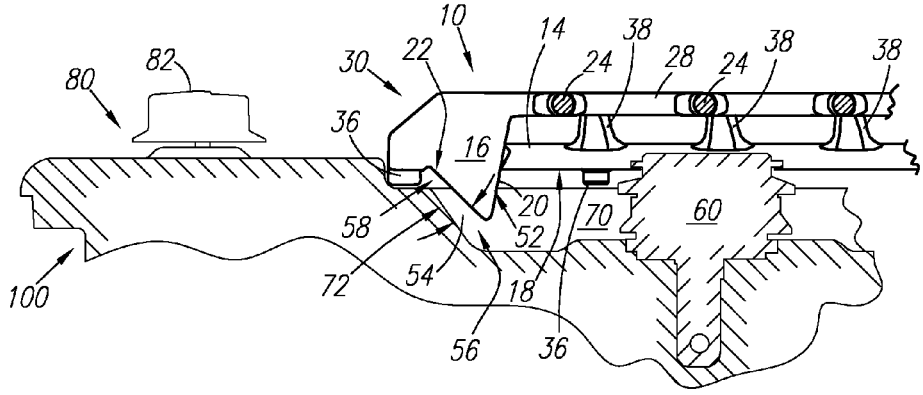
FIG. 5 is an opposite side view of the grate of FIG. 1*a* that shows an example cooking surface of the cooking apparatus.
Figure 6:
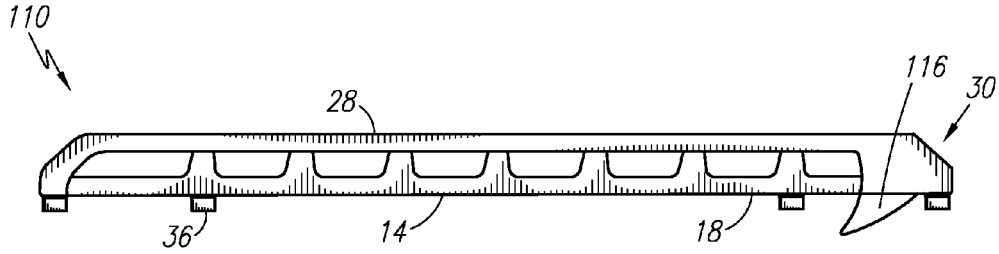
FIG. 6 is a side view of a second example grate.

In FIG. 5, a sectional side view is shown of the grate 10 located in the cooking surface 70 of the cooking apparatus 100 above a heat source 60. The grate 10 is supported by the plurality of feet 36 in this example, though other supporting arrangements can be used that do not include the plurality of feet 36. FIG. 5 also shows an example location of the guard 16. In this example, the guard 16 is integrally molded with one side of the frame member 14 of the grate 10. In other examples, the guard 16 can be located on one or more portions of one side of the frame member and/or on more than one side of the grate 10. In another example, the guard 16 can be located at a position closer to the heat source 60, in the interior of the grate 10. It is to be appreciated that the guard can be a separate member from the grate and can be connected thereto in any desired manner.

A channel 54 is formed between the second side 22 of the guard 16 and the sidewall 72 of the cooking surface 70. The second side 22 of the guard 16 can correspond to the sidewall 72 of the cooking surface 70 such that it is relatively parallel to the sidewall 72 of the cooking surface 70. The channel 54 is configured to create a first thermal barrier between the at least one heat source 60 and the control panel 80. More specifically, the channel 54 facilitates dissipation and absorption of the heat radiating from the at least one heat source 60 by through the air space. A second thermal barrier is created by the guard 16 itself as the material of the guard can function as a heat sink. In other examples, the second side 22 of the guard 16 can be angled and/or curved relative to the sidewall 72 of the cooking surface 70. Further, the air space between the second side 22 of the guard 16 and the sidewall 72 of the cooking surface 70 can vary in size or shape between a first end 56 and a second end 58 of the channel. In another example, the variation in the air space of the channel 54 can be increasing in size or decreasing in size between the first end 56 and the second end 58. In yet another example, the variation in the channel 54 can alternately change between smaller and larger sizes.

The guard 16 can be spaced a distance from the sidewall 72 of the cooking surface 70 such that the channel 54 is configured to allow a flow of air through the channel 54. In this example, the channel 54 has higher temperature air entering the air space from the first end 56 but lower temperature air being present at the exterior of the second end 58 of the air space. As the higher temperature air escapes through the channel to the second end 58, where lower temperature air is present, an air flow occurs in the air space. The air flow that is occurring is at least partially a result of the difference in temperatures between the first end 56 and the second end 58. If the shield 16 is placed too far away from a sidewall 72 of the cooking surface 70, it becomes less likely that a flow of air will be achieved and the flow of air may not occur throughout the entire channel 54.

While FIG. 5 shows a foot 36 blocking the second end 58, the majority of the air space of the channel 54 along the perimeter of the grate can communicate with the external air. In this example, a foot 36 rests on a portion of the cooking surface 70. Varying dimensions and geometries can be used for the cooking surface 70. In other examples, the foot 36 can rest on the top surface of the cooking surface 70 and the guard 16 can extend downwardly into the cooking surface 70.

In FIG. 3 and FIG. 4, the guard 16 is shown in a generally straight configuration as it extends between a left side 32 of the grate 10, shown in FIG. 1A, and a right side 34 of the grate 10. In other examples, the guard 16 can have a generally curved geometry to deflect the radiant heat in directions such as upwards and away from a control panel 80. For example, turning to FIG. 6, a grate 110 can be provided where at least one of the first side and the second side of the guard 116 has a curved cross-section to further deflect and shield the heat from the heat source 60. This example shows that the guard 116 can be curved when viewed from the side, similar to the view of FIG. 2. This shape also can result in the guard 116 deflecting the heat in a direction away from the control panel 80. This example also can result in different sizes for the guard 116. For instance, the guard 116 is a thermal barrier based on the amount of material in the guard 116. The different shape for the guard 116 results in a different size of the thermal barrier. A channel is formed between a side of the guard 116 and a sidewall 72 of the cooking surface 70. The channel is configured to act as a thermal barrier. The different shape for the guard 116 results in a different shape for the air space in the channel. Thus, different shapes for the guards 16, 116 result in different shapes for the thermal barriers.

Figure 7:
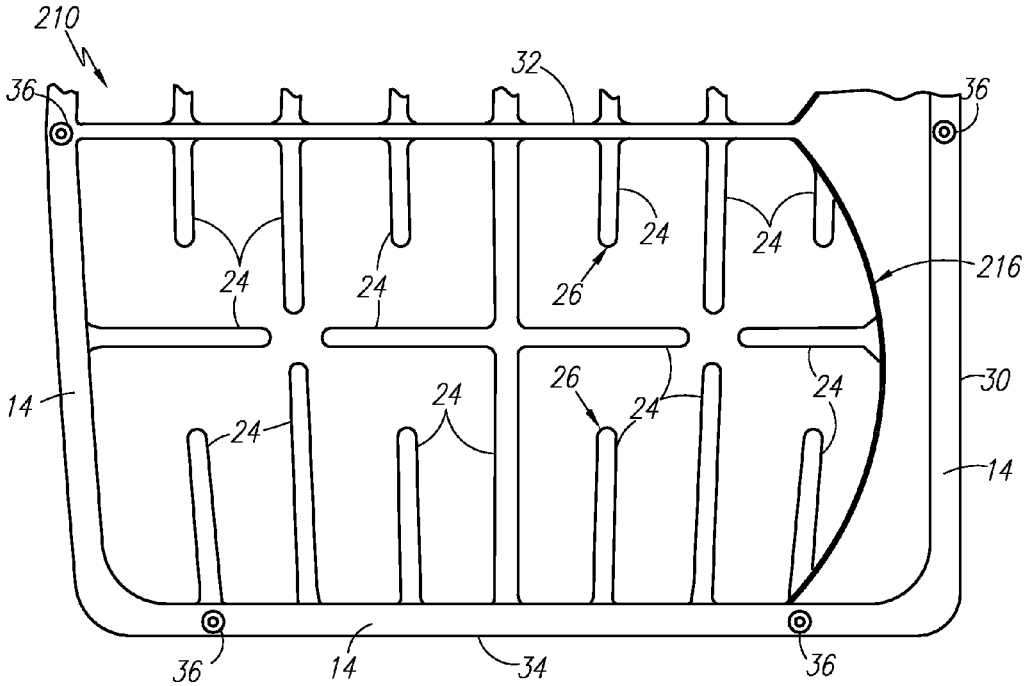
FIG. 7 is a bottom view of a third example grate.

In another example, shown in FIG. 7, a grate 210 can be provided with a guard 216 that can have a curved length along a long axis to further deflect the heat from a heat source 60. This example shows that the guard 216 can be curved when viewed from the bottom, similar to the view of FIG. 4. This example shows that a curvature can be used to achieve an increased constant distance from a heat source 60 to the guard 216. In other examples, different types of curvatures can be selected even if it results in different distances from the heat source 60 to the guard 216. In other examples, the guard 216 can be curved in both the side view and the top view.

The invention has been described with reference to the example embodiments described above. Modifications and alterations will occur to others upon a reading and understanding of this specification. Examples embodiments incorporating one or more aspects of the invention are intended to include all such modifications and alterations insofar as they come within the scope of the appended claims.

What is claimed is:

1. A cooking apparatus comprising:

a cooking surface including at least one heat source and a control panel;

at least one grate provided over a portion of the cooking surface;

a guard coupled to the at least one grate, the guard including a first side and a second side;

wherein the first side of the guard is configured to deflect heat radiating from the at least one heat source; and wherein the second side of the guard is spaced a distance from a sidewall of the cooking surface to form a channel between the guard and the sidewall, the channel being configured to create a first thermal barrier between the at least one heat source and the control panel, further wherein air is configured to flow from a first side of the guard to a second side of the guard and through the channel.

2. A cooking apparatus according to claim 1, wherein the guard extends below a bottom surface of the at least one grate.

3. A cooking apparatus according to claim 1, wherein the guard has a curved length along a long axis.

4. A cooking apparatus according to claim 1, wherein at least one of the first side and the second side of the guard has a curved cross-section.

5. A cooking apparatus according to claim 1, wherein the guard has a triangular-shaped cross-section.

6. A cooking apparatus according to claim 1, wherein the guard is located on a portion of the at least one grate between the control panel and the at least one heat source.

7. A cooking apparatus according to claim 1, wherein the second side of the guard is relatively parallel to the sidewall of the cooking surface.

8. A cooking apparatus according to claim 1, wherein the channel between the second side of the guard and the sidewall of the cooking surface varies in size between a first end and a second end.

9. A cooking apparatus according to claim 1, wherein the first side of the guard is sloped from a bottom portion upwards in a direction towards the at least one heat source.

10. A cooking apparatus according to claim 1, wherein the second side of the guard is sloped from a bottom portion upwards in a direction towards a front side of the at least one grate.

11. A cooking apparatus according to claim 1, wherein the at least one grate is configured to support a cooking implement.

12. A cooking apparatus according to claim 1, wherein the guard is coupled to a portion of a perimeter of the at least one grate.

13. A cooking apparatus according to claim 1, wherein the material of the guard creates a second thermal barrier.

14. A cooking apparatus comprising:

a cooking surface including at least one heat source and a control panel;

at least one grate provided over a portion of the cooking surface;

a guard coupled to the at least one grate, the guard including a first side and a second side;

wherein the first side of the guard is configured to deflect heat radiating from the at least one heat source;

wherein the second side of the guard corresponds with a sidewall of the cooking surface to form a channel between the guard and the sidewall, the channel being configured to create a first thermal barrier between the at least one heat source and the control panel;

wherein the guard is spaced a distance from the sidewall of the cooking surface so as to allow a flow of air through the channel, wherein the flow of air is configured to flow from the first side of the guard to the second side of the guard; and wherein the first side of the guard is sloped from a bottom portion in an upwards direction towards the at least one heat source.

15. A cooking apparatus according to claim 14, wherein the guard extends below a bottom surface of the at least one grate.

16. A cooking apparatus according to claim 14, wherein the guard is located on a portion of the at least one grate between the control panel and the at least one heat source.

17. A cooking apparatus according to claim 14, wherein the second side of the guard is relatively parallel to the sidewall of the cooking surface.

18. A cooking apparatus according to claim 14, wherein the channel between the second side of the guard and the sidewall of the cooking surface varies in size between a first end and a second end.

19. A cooking apparatus according to claim 14, wherein the second side of the guard is sloped from a bottom portion upwards in a direction towards a front side of the at least one grate.

20. A cooking apparatus according to claim 14, wherein the guard is coupled to a portion of a perimeter of the at least one grate.

* * * * *